US006375308B1

(12) United States Patent
Shimada

(10) Patent No.: US 6,375,308 B1
(45) **Date of Patent: *Apr. 23, 2002**

(54) INK JET RECORDING APPARATUS WITH HIGH AND LOW COLOR-DENSITY INKS

(75) Inventor: Kazumichi Shimada, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/942,140

(22) Filed: Sep. 29, 1997

(30) Foreign Application Priority Data

Sep. 28, 1996 (JP) ..... 8-277461

(51) Int. Cl.[7] ..... B41J 2/21; B41J 2/175
(52) U.S. Cl. ..... 347/43; 347/86
(58) Field of Search ..... 347/43, 86, 7

(56) References Cited

U.S. PATENT DOCUMENTS 4,543,590 A * 9/1985 Tazaki et al. ..... 347/43
5,479,193 A * 12/1995 Shimoda et al. ..... 347/7
5,602,574 A * 2/1997 Williams ..... 347/43
5,731,825 A 3/1998 Danzuka et al. ..... 347/15
5,742,306 A * 4/1998 Gompertz et al. ..... 347/43
5,764,260 A * 6/1998 Vu et al. ..... 347/87
5,969,739 A 10/1999 Altendorf et al. ..... 347/87

FOREIGN PATENT DOCUMENTS

EP 0 388 978 9/1990
EP 0 626 266 11/1994
EP 0 627 323 12/1994
JP 3-189167 * 8/1991 ..... 347/43
JP 8-58075 8/1994

* cited by examiner

*Primary Examiner*—Thinh Nguyen
(74) *Attorney, Agent, or Firm*—Stroock & Stroock & Lavan LLP

(57) ABSTRACT

An ink jet recording apparatus including a supply roller for supplying a sheet in a sheet feed direction. A carriage is slidably mounted within the ink jet printer for displacement in a scanning direction. A head is mounted on the carriage, and a first ink cartridge containing high color-density inks of a plurality of colors and a second ink cartridge containing low color-density inks of a plurality of colors are mounted on the carriage for supplying ink to the head. First and second ink cartridges are removably attached to the head and may be positioned adjacent to each other in a sheet feed direction, in a scanning direction or in a direction orthogonal to the sheet feed direction and the scanning direction.

60 Claims, 4 Drawing Sheets

INK JET RECORDING APPARATUS WITH HIGH AND LOW COLOR-DENSITY INKS

BACKGROUND OF THE INVENTION

The present invention pertains generally to an ink jet recording apparatus that utilizes an ink cartridge to record on a printing medium, and more particularly to an ink jet printer that includes both high color-density and low color-density inks. The present invention relates also to an ink cartridge itself containing both high and low color-density inks.

Recently, standard color printers have been used as output devices for personal computers and the like, and color ink jet printers have followed this trend. A color ink jet recording apparatus of this type is constructed so that color inks such as black, yellow, magenta, and cyan inks are loaded into a print cartridge to permit the ink jet printer to produce a plurality of colors that mimic the full range of colors available in a standard color printer.

A conventional example of such an apparatus is disclosed in Unexamined Japanese Patent Publication No. Hei. 8-58075. The main feature of this prior art ink jet recording apparatus is that high color-density inks and low color-density inks are contained in a single ink cartridge for each color, so that the printer can print using variable ink color-density. As a result of this ability to print in different color-density, ink dots that would typically be noticeable as highlighted portions may be replaced with ink dots recorded with lower color-density ink thereby rendering the dots unnoticeable and producing a more natural image. Hence, a high-definition recording can be provided, especially where the apparatus is used to print photographs.

One of the primary deficiencies of conventional printers, such as that described above, is that they tend to consume high color-density inks in more quickly than low color-density inks when images with vivid impressions are formed. Similarly, the conventional printers tend to consume low color-density inks in larger quantities than high color-density inks when images with highlighted portions, such as photographs, are formed. That is, there is often a large difference in the rate of consumption between the high and low color-density inks, depending on the type of image recorded. Often, in such a conventional printer, either the high color-density ink or low color-density ink of a particular color is completely dispensed, leaving the other type of ink remaining in sufficient quantities. As a result, when the ink cartridge is replaced, the remaining ink is wasted, which unnecessarily elevates the cost of printing. Accordingly, it is desired to provide an ink jet recording apparatus that overcomes the drawbacks accompanying the conventional art.

SUMMARY OF THE INVENTION

Generally, in accordance with the present invention, an ink jet printer is provided for printing information onto a recording medium. The printer utilizes high color-density inks of a plurality of different colors and low color-density inks of a plurality of different colors, and further includes a first ink cartridge unit that contains the high color-density inks of a plurality of different colors, and a second ink cartridge unit that contains the low color-density inks of a plurality of different colors.

More specifically, an ink jet recording apparatus of the present invention includes a supply roller for supplying the sheet in a sheet feed direction. A carriage is slidably mounted within the ink jet printer for displacement in a scanning direction. A head is mounted on the carriage, and a first ink cartridge containing high color-density inks of a plurality of colors and a second ink cartridge containing low color-density inks of a plurality of colors are mounted on the carriage for supplying ink to the head.

Accordingly, an object of the invention is to provide an ink jet recording apparatus that can effectively use high and low color-density inks and reduce costs by overcoming the aforementioned problems accompanying conventional devices.

Another object of the invention is to provide an ink jet recording apparatus with an improved printing efficiency by optimally positioning the ink supply ports of an ink cartridge containing high color-density ink, and an ink cartridge containing low color-density ink.

Still another object of the invention is to provide an ink jet recording apparatus that enables a stable resolution printing processes by providing a structure for cleaning the individual ink color nozzles.

Yet another object of the invention is to provide an ink jet recording apparatus that allows inks to be used uniformly by providing only some inks of the same color-density, so that inks may be used without waste.

A further object of the invention is to provide an ink jet recording apparatus that can avoid wasting ink by detecting when the ink in a particular cartridge has been exhausted.

Another object of the invention is to provide an ink jet recording apparatus that allows high and low color-density ink cartridges to be removably attached without error by providing a means of identifying cartridges that contain high color-density ink and cartridges that contain low color-density ink.

Another object of the invention is to provide an ink jet recording apparatus that can check the attached conditions of ink cartridges safely, so that erroneous operation can be prevented.

Yet another object of the invention is to provide an ink jet recording apparatus that allows only an unused ink cartridge to be used for printing, so that printing quality can be ensured.

Still another object of the invention is to provide an ink jet recording apparatus that simplifies the structure of the printer by integrating an ink cartridge with a recording head.

Still other objects and advantages of the invention will in part be obvious and will in part be apparent from the specification and drawings.

The invention accordingly comprises the features of construction, combinations of elements, and arrangements of parts exemplified in the constructions hereinafter set forth. The scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
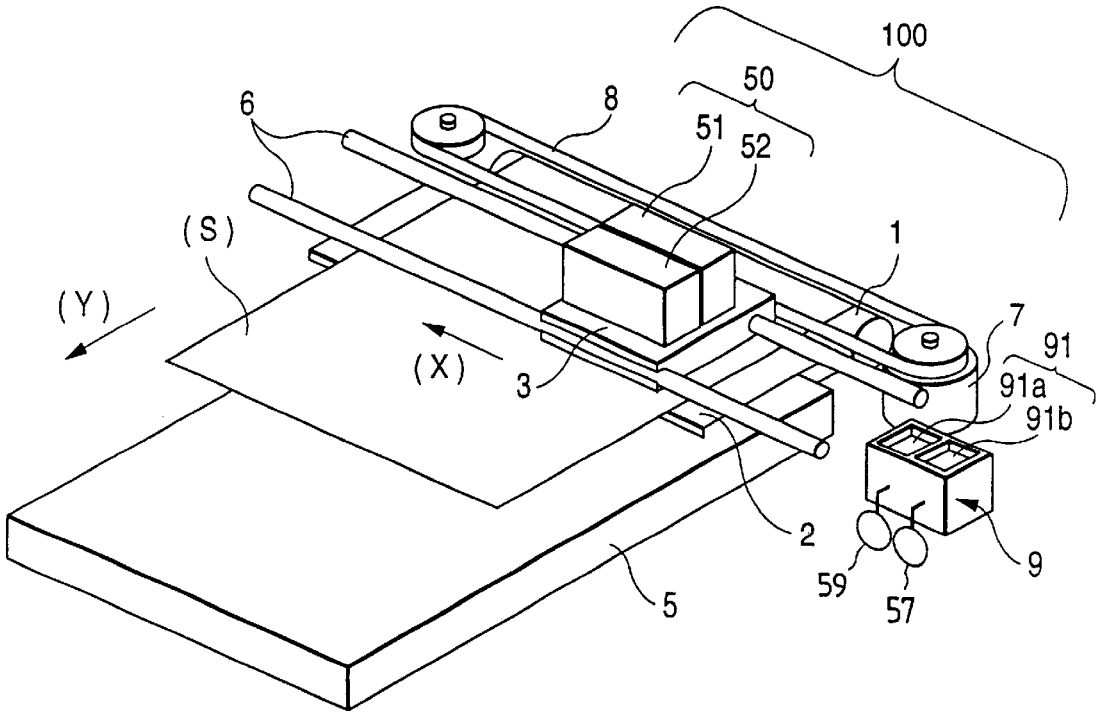
FIG. 1 is a perspective view illustrating an ink jet recording apparatus in accordance with a first embodiment of the present invention.

Referring now to FIG. 1, an ink jet printer or recording apparatus is generally indicated at 100 and is constructed in accordance with the preferred embodiment of the invention.

An ink jet printer 100 includes at least one feed roller 1 mounted within printer 100 and driven by a step motor (not shown). Feed roller 1 feeds a sheet S of a recording medium to a platen 2 in a sheet feed direction Y, perpendicular to the length direction of feed roller 1. A carriage 3 is slidably mounted on rails 6, which are mounted within the body of printer 100. Carriage 3 supports an ink jet head 4 thereon for ejecting ink droplets onto sheet S. Carriage 3 is coupled to a timing belt 8 that is driven by a step motor 7, and is reciprocally displaceable in a scanning direction X along guide rails 6. Scanning direction X is substantially orthogonal to sheet feed direction Y. A sheet stacker 5 is disposed within printer 100 to provide a platform from which sheets S may be fed by feed roller 1.

Figure 2:
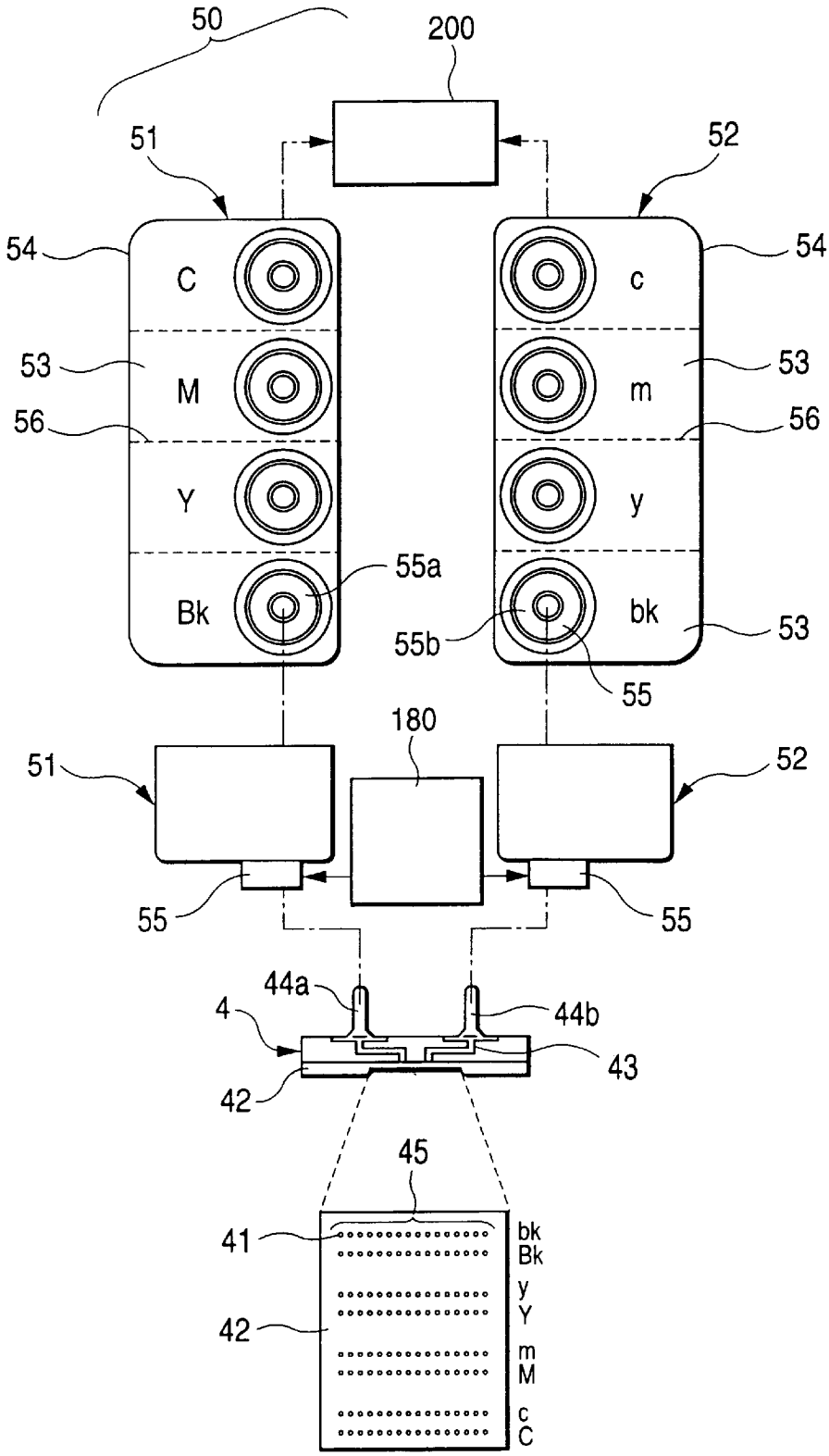
FIG. 2 is an exploded schematic view of a recording head and ink cartridges of FIG. 1.

Referring to FIGS. 1 and 2, recording head 4 is mounted on carriage 3. An ink cartridge 50 is attached to recording head 4, and includes a high color-density ink cartridge 51 and a low color-density ink cartridge 52. Ink cartridge 50 may be integral with or separate from recording head 4. Preferably, ink cartridges 51 and 52 extend so as to be positioned adjacent to each other in scanning direction X.

High color-density ink cartridge 51 and low color-density ink cartridge 52 each are preferably constructed as separate ink containers, arranged side-by-side. Low color-density ink cartridge 51 and high color-density ink cartridge 52 each include a plurality of ink chambers 53 having partition walls 56 and a common, outer case 54. Separate ink chambers 53 contain a plurality of different inks. In a preferred embodiment, ink chambers 53 contain high color-density cyan ink (denoted as C) and low color-density cyan ink (denoted as c), and high and low color-density magenta (M, m), yellow (Y, y), and black (Bk, bk) inks. High color-density inks have a higher in color-density than low color-density inks.

A plurality of ink supply ports 55 for introducing inks from the respective ink chambers 53 are provided for each ink chamber 53 contained in ink cartridge 50, with high color-density ink supply ports denoted as 55*a,* and low color-density ink supply ports denoted as 55*b.* As is shown in FIG. 2, high color-density ink supply ports 55*a* can be positioned adjacent low color-density ink supply ports 55*b* in the sheet feed direction. Preferably, high color-density ink supply port 55*a* corresponding to a particular color, such as yellow, is positioned adjacent low color-density ink supply port 55*b* for the same color.

A nozzle plate 42 is disposed on a lower surface of recording head 4, and includes a plurality of nozzles 41 that extend in the sheet feed direction Y to form nozzle arrays 45. Nozzles 41 are arranged in the form of a plurality of arrays 45 that include, for example, a low color-density black ink nozzle array bk and a high color-density black ink nozzle array Bk. Recording head 4 includes a plurality of pressure chambers, whose construction is well known in the art, that communicate separately with each of the plurality of nozzles and ink chambers 53 (described below). Hollow ink supply needles 44 are formed on the top surface of recording head 4. A plurality of throughholes are formed on the tips of supply needles 44 for communicating within ink chambers 53 through needles 44 to ink supply passages 43 formed in recording head 4. This allows ink contained within ink chambers 53–56 to travel from the chambers to nozzles 41. Recording head 4 includes multiple ink supply passages 43 for supplying inks from the common ink chambers. In such an embodiment, high color-density ink supply needles 44*a* and low color-density ink supply needles 44*b* are arranged in the scanning direction so as to be positioned to compliment respective high and low color-density ink supply ports 55*a* and 55*b.* Ink supply needles 44 are designed to be connected to ink supply ports 55 of ink cartridge 50.

Figure 3:
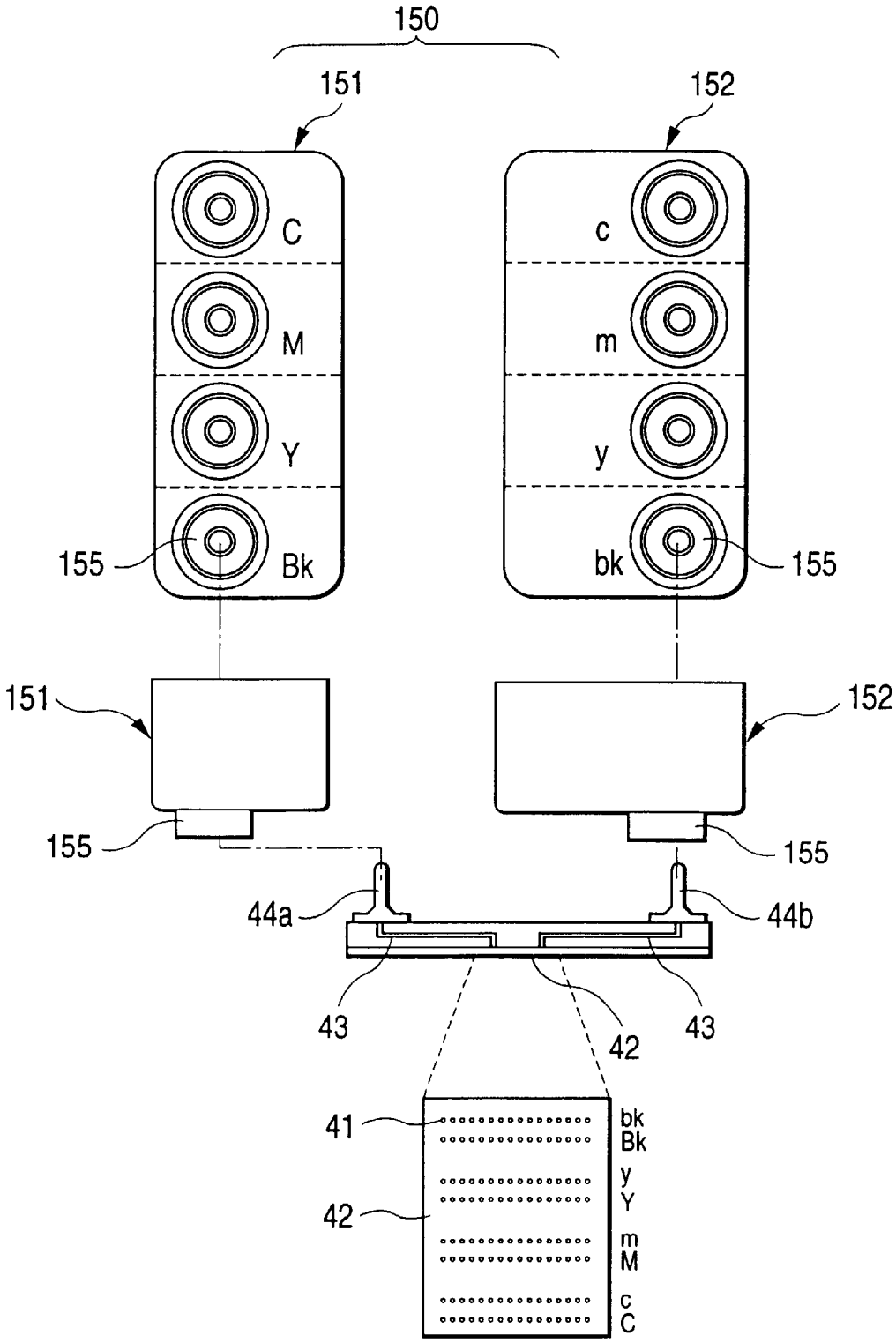
FIG. 3 is an exploded schematic view of a recording head and ink cartridges illustrating of an ink jet recording apparatus in accordance with a second embodiment the present invention.

In a second embodiment, the ink supply port positions may be changed and moved, and like numerals will be used to indicate like structure. As is shown in FIG. 3, a cartridge 150 includes a high color-density ink cartridge 151 and a low color-density ink cartridge 152. When disposed in side-by-side relation the high color-density ink supply ports 155*a* and low color-density ink supply ports 155*b* are spaced apart in the sheet feed direction, and the respective high and low color-density ink supply needles 144*a* and 144*b* are formed on head 4 so as to correspond to the location of ink supply ports 155.

Referring again to FIG. 1, the position of ink supply cartridges 51, 52 and ink supply ports 55 may be changed by altering the attachment pattern of ink cartridge 50. For example, high color-density ink cartridge 51 may be positioned above low color-density ink cartridge 52 in a direction orthogonal to both the scanning and sheet feed directions. Further, as is described below, high color-density ink cartridge 51 may be adjacent low color-density ink cartridge 52 in the scanning direction. As is known in the art, printer 100 may be provided with a position sensor (not shown) to detect the manner in which ink cartridge 50 is attached, and to detect whether high color-density ink cartridge 51 and low color-density ink cartridge 52 are properly attached to head 4. Such a sensor can be set to prevent operation of printer 100 when either high color-density ink cartridge 51 or low color-density ink cartridge 52 are not properly engaged with head 4.

As is shown in FIG. 1, printer 100 includes a cleaning section 9. Cleaning section 9 is large enough to cover nozzles 41 of recording head 4, and includes a cap 91 formed of an elastic material containing a porous member. Cap 91 may include a cap 91*a* for high color-density ink and a cap 91*b* for low color-density ink, which are positioned to cover nozzles 41 of recording head 4 corresponding to ink cartridges 51 and 52.

Cleaning section 9 includes pumps 57 and 59, which are connected to cap 91 through a pipe, for forcibly discharging inks from nozzles 41 in the event the nozzles 41 become clogged. While cleaning section 9 is depicted having two pumps, the invention contemplates using one pump as well. When nozzles 41 of recording head 4 are to be unclogged, the openings of nozzles 41 are covered with cap 91 and a negative pressure is produced within cap 91 by operation of the pump so as to forcibly discharge the clogged ink from nozzles 41. Cleaning section 9 also includes a wiper member made of an elastic material, such as rubber, and a rubbing member made of a porous material, which are not shown. The wiper member cleans dust and unnecessary ink deposited on the nozzle surfaces of recording head 4.

Alternatively, cap 91 may be divided into ink caps that can be positioned to cover the high and low color-density ink nozzle openings of a common color. For example, cap 91 may be constructed to have four separate ink caps, one for each color shown in FIGS. 2–4. In this manner, one ink cap is provided for the high and low color-density ink having a yellow hue. Similarly, another ink cap is provided for the high and low color-density inks having black, cyan and magenta hues. The remaining construction of cleaner 9 is similar to that described above.

Based upon the above construction, the ink jet printer operates as follows. As shown in FIGS. 1 and 2, high color-density ink cartridge 51 and low color-density ink cartridge 52 are mounted on carriage 3 and are aligned in the scanning direction X to be adjacent to each other. Ink cartridge 50 is positioned on carriage 3 so that ink supply needles 44 of recording head 4 cooperatively fit into ink supply ports 55. To print characters or images, the printer operator commands a print operation, and, as a result, print sheet S is fed by sheet feed roller 1 from sheet stacker 5 and forwarded on the surface of platen 2 in the sheet feed direction. As this occurs, carriage 3 is pulled by timing belt 8 in the scanning direction along guide rail 6 under power of step motor 7, and inks supplied from ink chambers 53 within ink cartridge 50 via ink supply needles 44 and ink supply passages 43 are ejected onto sheet S from nozzles 41. Sheet S is then subjected to further printing and is progressively fed in sheet feeding direction Y until it is discharged onto a containing section (not shown).

During the printing operation, high-quality printing may be implemented by furnishing ink supply commands that call for the high and low color-density inks contained in the ink chambers 53 of ink cartridge 50 to be supplied selectively. That is, for printing dark or dense presentation materials, high color-density inks are mainly supplied from high color-density ink cartridge 51, whereas for printing photographs that include highlighted or diffuse portions, low color-density inks are mainly supplied from low color-density ink cartridge 52.

Referring to FIG. 2, in a preferred embodiment of the invention, printer 100 is provided with an ink exhaustion detector 180 that can detect when an ink chamber is depleted by a projection, an electric contact, or another means known to those skilled in the art. In addition, in a preferred embodiment of the invention, high color-density ink cartridge 51 and/or low color-density ink cartridge 52 are provided with an identifying characteristic 200 that identifies ink cartridge 51 as a high color-density ink cartridge and/or identifies ink cartridge 52 as a low color-density ink cartridge. Identifying characteristic 200 may be constructed by using an element for converting electrical energy to mechanical energy on a drive section of recording head 4 or by using an element for converting electrical energy to heat on the drive section of recording head 4 or by other techniques known in the art.

When particular inks in ink cartridge 50 have been exhausted as a result of a printing operation, high color-density ink cartridge 51 or low color-density ink cartridge 52 may be selectively removed from ink cartridge 50 for replacement because both high color-density ink cartridge 51 and low color-density ink cartridge 52 are integrated, unitary bodies containing inks of different colors in their respective ink chambers 53. As such, the high color-density inks and low color-density inks that heretofore were wasted may be used for printing purposes until a particular ink is depleted. As a result, running costs can be reduced significantly.

As is shown in FIG. 3, in a second embodiment of the invention where like reference numerals indicate like parts, ink cartridge 150 includes a set of low color-density ink supply needles 144*a* and a set of high color-density ink supply needles 144*b*, each set of supply needles 144*a*, 144*b* extending in the scanning direction. Low color-density ink supply needles 144*a* are spaced apart from high color-density ink supply needles 144*b*. In a preferred embodiment of the invention, low color-density ink supply needles 144*a* are arranged at a remote position in the sheet feed direction from high color-density ink supply needles 144*b*. Ink cartridge 150 includes ink supply ports 155, which are positioned to be engageable with low and high color-density ink supply needles 144*a* and 144*b*. In this manner, low color-density ink cartridge 152 can be constructed to have a larger (or smaller) ink capacity than high color-density ink cartridge 151.

In such an embodiment, a user may specify the more appropriate combination of cartridges and cartridge capacities. That is, where the images to be printed have predominantly highlighted portions, the capacity of the low color-density ink cartridge may be increased to provide more low color-density ink to more efficiently match the type of ink to the type of image to be printed. By placing the ports at the outer edges of the cartridges, the user may alter the capacity of either low or high color-density ink depending on the type of image to be printed, without altering the arrangement of the supply needles because of the remote location of supply ports 55.

Figure 4:
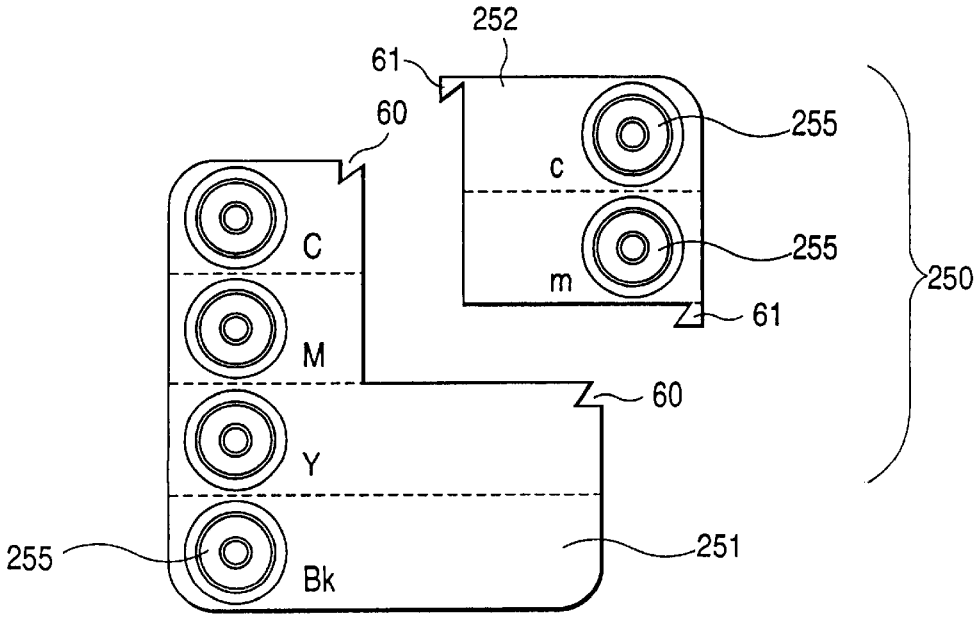
FIG. 4 is an exploded view of a combination of ink cartridge, illustrating an ink jet recording apparatus in accordance with a third embodiment of the present invention.

As is shown in FIG. 4, in a third preferred embodiment where like reference numerals indicate like parts, ink cartridge 250 includes high and low color-density inks in cyan and magenta, but only one color-density of yellow and black ink. Because cyan and magenta are colors used to produce high-quality images, some users may find it advantageous to have two color-densities of cyan and magenta ink, but maynot require different color-densities of yellow and black. In such an embodiment, high color-density ink cartridge 251 can be formed in an L-shaped, and can include at least one recessed portion 60, and low color-density ink cartridge 252 can be formed in a rectangular shape, and can include at least one projected portion 61. In a preferred embodiment of the invention, one projected portion 61 is constructed and arranged on diagonally opposite corners of low color-density ink cartridge 252 to engage recessed portions 60 of high color-density ink cartridge 251 such that high and low color-density ink cartridges 251 and 252, when engaged, form integral ink cartridge 250.

In this manner, low color-density ink cartridge 252 may be formed having ink chambers 253 of only cyan and magenta, in a configuration like that shown in FIG. 4, or any arrangement having a different number of ink cartridges than high color-density ink cartridge 251. Where a large quantity of cyan and magenta low color-density inks is desirable, low color-density ink cartridge 252 may be formed in the configuration of FIG. 3 without providing ink chambers for yellow and black low color-density inks. That is, so long as each ink is provided an appropriate supply port 255, low color-density ink cartridge 252 may be formed such that the quantity and number of different colored inks is variable. Similarly, where large quantities of high color-density inks or a particular color of high color-density ink is desirable, high color-density ink cartridge 251 may be formed such that the capacity of high color-density ink cartridge 251 is increased compared to low color-density ink cartridge 252 by allocating some of the capacity of low color-density ink cartridge 252 to high color-density ink cartridge 251. In either case, this embodiment facilitates the user's ability to manage the use of ink cartridges because the user can select ink cartridge 250 according to the quantities of inks to be consumed.

Figure 5:
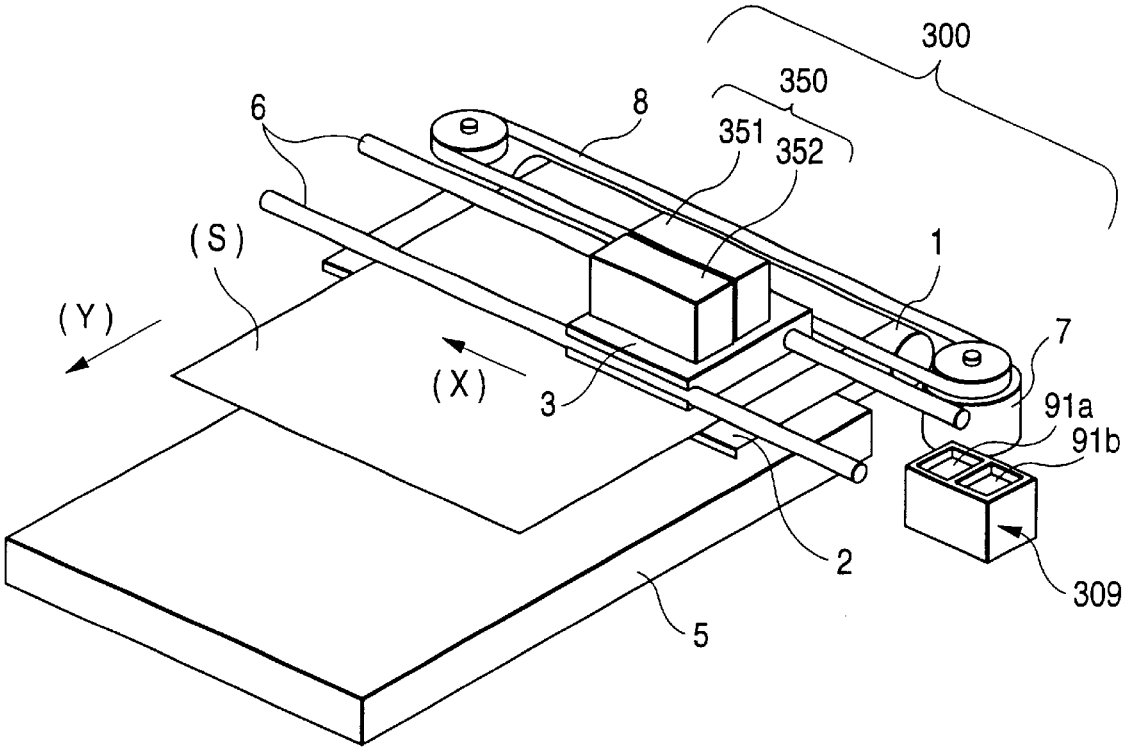
FIG. 5 is a perspective view of an ink jet recording apparatus illustrating an ink jet recording apparatus in accordance with a fourth embodiment of the present invention.
Figure 6:
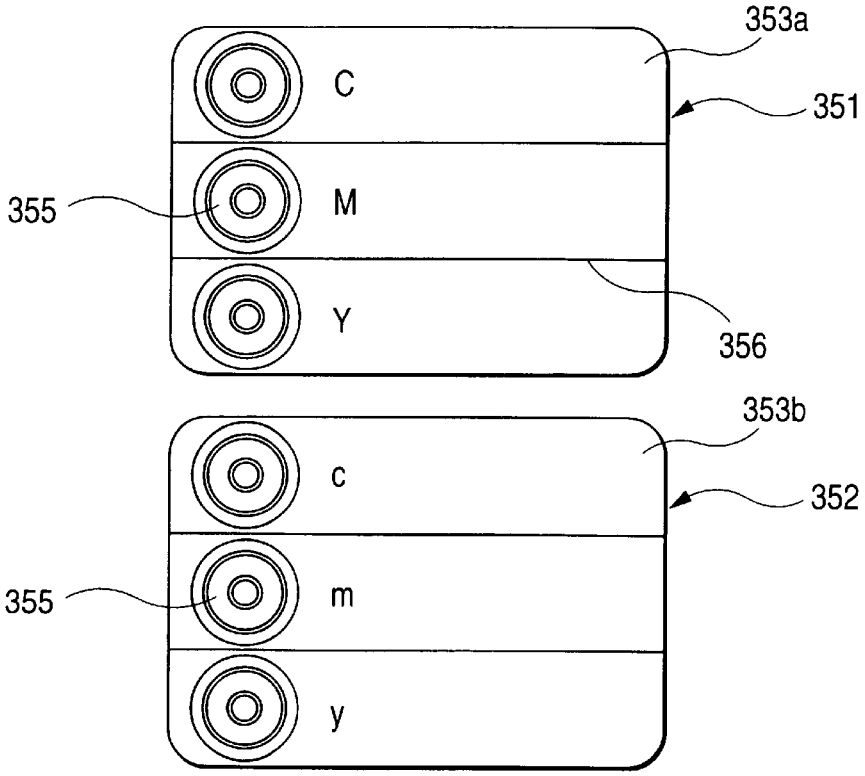
FIG. 6 is a bottom plan view of a combination of the ink cartridges of FIG. 5.

As is shown in FIGS. 5 and 6, in another preferred embodiment of the invention, a printer 300 is constructed similarly to that depicted in FIG. 1 except that high color-density ink chambers 353*a* of high color-density ink cartridge 351 and low color-density ink chambers 353*b* of low color-density ink cartridge 352 are constructed and arranged on carriage 3 such that each chamber spans the length of ink cartridge 350 in scanning direction X and supply ports 355 are aligned in paper feed direction Y. In such an arrangement, the ink supply needles (not shown) are arranged in a single row in sheet feed direction Y to engage ink supply ports 355 as shown in FIG. 6. Further, in such an embodiment, cleaning section 309 is modified to cap the different arrangement of nozzle openings of recording head 4. Rather than having ink caps 91 that extend in sheet feed direction Y, ink caps 91 extend in scanning direction X so that each ink cap 91 covers a different color's ink supply needle. Other aspects of the construction of such an embodiment are similar to those depicted in FIGS. 1 and 2.

While FIG. 6 shows one example in which high color-density ink cartridge 351 and low color-density ink cartridge 352 each have yellow, magenta and cyan inks, it is understood that simple modifications in ink containers such as those described above may be made. For example, black ink containing chambers may be added to respective ink cartridges 351 and 352, and low color-density ink cartridge 352 may be provided with only cyan and magenta inks.

Using a printer of the above construction provides many advantages. In such a construction, a simply designed printer having removably attached ink cartridges may be employed to record high-quality images using high and low color-density inks without wasting any ink. In this way the cost of printing is reduced, and the operability of the printer and printing efficiency is improved by changing the ink cartridges less frequently.

It will thus be seen that the objects set forth above, among those made apparent from the preceding description, are efficiently attained and, since certain changes may be made in carrying out the above apparatus without departing from the spirit and scope of the invention, it is intended that all matter contained in the above description shall be interpreted as illustrative and not in a limiting way.

It is also to be understood that the following claims are intended to cover all of the generic and specific features of the invention herein described and all statements of the scope of the invention which, as a matter of language, might be said to fall therebetween.

What is claimed is:

1. An ink jet recording apparatus for printing onto a recording medium, comprising:

a supply roller for supplying the medium in a sheet feed direction;

a carriage slidably mounted on said ink jet recording apparatus for displacement in a scanning direction, said scanning direction substantially orthogonal to said sheet feed direction;

a print head mounted on said carriage;

a first, separable ink cartridge formed with a plurality of chambers respectively containing high color-density inks of a plurality of colors mounted on said carriage for supplying high color-density ink to said head; and a second, separable ink cartridge formed with a plurality of chambers respectively containing low color-density inks of a plurality of colors mounted on said carriage for supplying low color-density ink to said head, wherein said first ink cartridge is positioned adjacent to said second ink cartridge such that chambers in said first and second cartridges carrying ink of the same color but of different color density are aligned in adjacent relation.

2. The ink jet recording apparatus of claim 1, wherein said first ink cartridge and said second ink cartridge are removably attached to said carriage.

3. The ink jet recording apparatus of claim 1, wherein said first ink cartridge contains yellow, cyan and magenta inks, and said second ink cartridge contains cyan and magenta inks only.

4. The ink jet recording apparatus of claim 1, wherein said first ink cartridge has a plurality of first ink supply ports and said second ink cartridge has a plurality of second ink supply ports for communicating said first ink cartridge and said second ink cartridge with said head.

5. The ink jet recording apparatus of claim 4, wherein said first ink supply ports are positioned and arranged adjacent to said second ink supply ports.

6. The ink jet recording apparatus of claim 4, wherein said first ink supply ports are positioned and arranged so as to be spaced apart from said second ink supply ports.

7. The ink jet recording apparatus of claim 1, wherein said first ink cartridge is positioned adjacent to said second ink cartridge and the cartridges have surfaces facing each other in the sheet feed direction.

8. The ink jet recording apparatus of claim 1, wherein said first ink cartridge is positioned adjacent to said second ink cartridge and the cartridges have surfaces facing each other in the scanning direction.

9. The ink jet recording apparatus of claim 1, wherein said head includes a plurality of high color-density ink nozzles for ejecting high color-density ink onto the sheet and a plurality of low color-density ink nozzles for ejecting low color-density ink onto the sheet, and further comprising a cleaning section having a first ink cap and a second ink cap, said first ink cap being constructed and arranged to cover said plurality of high color-density ink nozzles and said second ink cap being constructed and arranged to cover said plurality of low color-density ink nozzles.

10. The ink jet recording apparatus of claim 1, wherein said head includes a plurality of high color-density ink nozzle arrays for ejecting high color-density ink onto the sheet and a plurality of low color-density ink nozzle arrays for ejecting low color-density ink onto the sheet, and further comprising a cleaning section having a plurality of ink caps, wherein each of said plurality of ink caps are constructed and arranged to cover a high color-density ink nozzle array and a low color-density ink nozzle array, said high color-density ink nozzle array and said low color-density ink nozzle array being constructed and arranged for ejecting ink of the same color.

11. The ink jet recording apparatus of claim 1, comprising a cleaning section having a first pump for cleaning said first ink cartridge and a second pump for cleaning said second ink cartridge.

12. The ink jet recording apparatus of claim 1, comprising an ink exhaustion detecting mechanism for detecting when the ink of said first ink cartridge has been expended and for detecting when the ink of said second ink cartridge has been expended.

13. The ink jet recording apparatus of claim 1, wherein the first and second ink cartridges include an identifying characteristic.

14. The ink jet recording apparatus of claim 1, comprising a sensor for preventing the operation of said ink jet recording apparatus when said first ink cartridge or said second ink cartridge is not properly mounted on said head.

15. The ink jet recording apparatus of claim 1, wherein said first ink cartridge and said second ink cartridge are formed integrally with said head.

16. The ink jet recording apparatus of claim 1, wherein said first ink cartridge and said second ink cartridge are constructed to contain different volumes of ink.

17. The ink jet recording apparatus of claim 1, wherein said first ink cartridge further comprises a plurality of ink chambers having a first volume for containing high color-density ink and said second ink cartridge further comprises a plurality of ink chambers having a second volume for containing low color-density ink, and said first volume is greater than said second volume.

18. The ink jet recording apparatus of claim 1, wherein said first ink cartridge further comprises a plurality of ink chambers having a first volume for containing high color-density ink and said second ink cartridge further comprises a plurality of ink chambers having a second volume for containing low color-density ink, and said second volume is greater than said first volume.

19. The ink jet recording apparatus of claim 17, wherein the number of said plurality of first ink cartridge chambers differs from the number of said plurality of second ink cartridge chambers.

20. The ink jet recording apparatus of claim 19, wherein said first ink cartridge chambers contain a select number of colors and said second ink cartridge chambers contain a different number of colors.

21. The ink jet recording apparatus of claim 20, wherein said first ink cartridge includes four chambers that contain cyan, magenta, yellow and black inks, respectively, and said second ink cartridge includes two chambers that contain cyan and magenta inks, respectively.

22. An ink cartridge for an ink jet recording apparatus having a print head for printing onto a recording medium, comprising:

a first, separable ink cartridge formed with a plurality of chambers respectively containing high color-density inks of a plurality of colors for supplying high color-density ink to the print head; and a second, separable ink cartridge formed with a plurality of chambers respectively containing low color-density inks of a plurality of colors for supplying low color-density ink to said head, wherein said first ink cartridge is formed to be positionable adjacent said second ink cartridge in a printing apparatus such that chambers in said first and second cartridges carrying ink of the same color but of different color density are aligned in adjacent relation.

23. The ink cartridge of claim 22, wherein said first ink cartridge and said second ink cartridge are removably attached to a part of the recording apparatus.

24. The ink cartridge of claim 22, wherein said first ink cartridge contains yellow, cyan and magenta inks, and said second ink cartridge contains cyan and magenta inks only.

25. The ink cartridge of claim 22, wherein said first ink cartridge has a plurality of first ink supply ports and said second ink cartridge has a plurality of second ink supply ports for communicating said first ink cartridge and said second ink cartridge with the print head.

26. The ink cartridge of claim 25, wherein said first ink supply ports are positioned and arranged adjacent to said second ink supply ports.

27. The ink cartridge of claim 25, wherein said first ink supply ports are positioned and arranged so as to be spaced apart from said second ink supply ports.

28. The ink cartridge of claim 22, wherein said first ink cartridge is positioned adjacent to said second ink cartridge and the cartridges have surfaces facing each other in the sheet feed direction.

29. The ink cartridge of claim 22, wherein said first ink cartridge is positioned adjacent to said second ink cartridge and the cartridges have surfaces facing each other in the scanning direction of the printing apparatus.

30. The ink cartridge of claim 22, wherein the first and second ink cartridges include an identifying characteristic.

31. The ink cartridge of claim 22, wherein said first ink cartridge and said second ink cartridge are formed integrally with the print head.

32. The ink cartridge of claim 22, wherein said first ink cartridge and said second ink cartridge are constructed to contain different volumes of ink.

33. The ink cartridge of claim 22, wherein said first ink cartridge further comprises a plurality of ink chambers having a first volume for containing high color-density ink and said second ink cartridge further comprises a plurality of ink chambers having a second volume for containing low color-density ink, and said first volume is greater than said second volume.

34. The ink cartridge of claim 33, wherein the number of said plurality of first ink cartridge chambers differs from the number of said plurality of second ink cartridge chambers.

35. The ink cartridge of claim 34, wherein said first ink cartridge chambers contain a select number of colors and said second ink cartridge chambers contain a different number of colors.

36. The ink cartridge of claim 35, wherein said first ink cartridge includes four chambers that contain cyan, magenta, yellow and black inks, respectively, and said second ink cartridge includes two chambers that contain cyan and magenta inks, respectively.

37. The ink cartridge of claim 22, wherein said first ink cartridge further comprises a plurality of ink chambers having a first volume for containing high color-density ink and said second ink cartridge further comprises a plurality of ink chambers having a second volume for containing low color-density ink, and said second volume is greater than said first volume.

38. An ink jet recording apparatus for printing onto a recording medium, comprising:

a carriage slidably mounted on said ink jet recording apparatus, slidably displaceable in a scanning direction;

a print head mounted on said carriage;

a first, separable ink cartridge formed with a plurality of chambers respectively containing high color-density inks of a plurality of colors mounted on said carriage for supplying high color-density ink to said head;

a second, separable ink cartridge formed with a plurality of chambers respectively containing low color-density inks, as compared with the inks of said first cartridge, of a plurality of colors mounted on said carriage for supplying low color-density ink to said head; and a nozzle plate disposed on a lower face of said print head, said nozzle plate having at least discrete first, second and third arrays of nozzles, said second array of nozzles being located intermediate said first and third arrays of nozzles, wherein said first array of nozzles is in fluid communication with a first of said chambers of said first ink cartridge, said second array of nozzles is in fluid communication with one of said chambers of said second ink cartridge, and said third array of nozzles is in fluid communication with a second of said chambers of said first ink cartridge.

39. The ink jet recording apparatus of claim 38, wherein said first ink cartridge and said second ink cartridge are removably attached with each other.

40. The ink jet recording apparatus of claim 38, wherein said first ink cartridge contains yellow, cyan and magenta inks, and said second ink cartridge contains cyan and magenta inks only.

41. The ink jet recording apparatus of claim 38, wherein said first ink cartridge has a plurality of first ink supply ports and said second ink cartridge has a plurality of second ink supply ports for communicating said first ink cartridge and said second ink cartridge with said head.

42. The ink jet recording apparatus of claim 41, wherein said first ink supply ports are positioned and arranged adjacent to said second ink supply ports.

43. The ink jet recording apparatus of claim 41, wherein said first ink supply ports are positioned and arranged so as to be spaced apart from said second ink supply ports.

44. The ink jet recording apparatus of claim 38, wherein said first ink cartridge is positioned adjacent to said second ink cartridge and the cartridges have surfaces facing each other in a direction orthogonal to the carriage sliding direction.

45. The ink jet recording apparatus of claim 38, wherein said first ink cartridge is positioned adjacent to said second ink cartridge and the cartridges have surfaces facing each other in the scanning direction.

46. The ink jet recording apparatus of claim 38, wherein said print head includes a plurality of high color-density ink nozzles positioned to eject high color-density ink onto the sheet and a plurality of low color-density ink nozzles positioned to eject low color-density ink onto the sheet.

47. The ink jet recording apparatus of claim 46, wherein said carriage is slidably displaceable between a plurality of printing positions and a cleaning position further comprising:

a cleaning section having a first cap covering said nozzles for ejecting high color-density ink when said carriage is in said cleaning position and a second cap covering said nozzles for ejecting low color-density ink at said cleaning position.

48. The ink jet recording apparatus of claim 38, wherein said print head includes a plurality of high color-density ink nozzle arrays positioned to eject high color-density ink onto the sheet and a plurality of low color-density ink nozzle arrays positioned to eject low color-density onto the sheet.

49. The ink jet recording apparatus of claim 48, wherein said carriage is slidably displaceable between a plurality of printing positions and a cleaning position further comprising:

a cleaning section having a first cap for covering said nozzle arrays for ejecting high color-density ink when said carriage is in said cleaning position and a second cap for covering said nozzle arrays for ejecting low color-density ink at said cleaning position.

50. The ink jet recording apparatus of claim 38, wherein said print head includes a first head having a plurality of high color-density ink nozzles positioned to eject high color-density ink onto the sheet and a second head having a plurality of low color-density ink nozzles positioned to eject low color-density ink onto the sheet.

51. The ink jet recording apparatus of claim 50, wherein said carriage is slidably displaceable between a plurality of printings position and a cleaning position further comprising:

a cleaning section having a first cap for covering said nozzles for ejecting high color-density ink when said carriage is in said cleaning position and a second cap for covering said nozzles for ejecting low color-density ink at said cleaning position.

52. The ink jet recording apparatus of claim 38, wherein the first and second ink cartridges include an identifying characteristic.

53. The ink jet recording apparatus of claim 38, wherein said first ink cartridge and said second ink cartridge are constructed to contain different volumes of ink.

54. The ink jet recording apparatus of claim 38, wherein said first ink cartridge further comprises a plurality of ink chambers having a first volume for containing high color-density ink and said second ink cartridge further comprises a plurality of ink chambers having a second volume for containing low color-density ink, and said first volume is greater than said second volume.

55. The ink jet recording apparatus of claim 54, wherein the number of said plurality of first ink cartridge chambers differs from the number of said plurality of second ink cartridge chambers.

56. The ink jet recording apparatus of claim 55, wherein said first ink cartridge chambers contain a select number of colors and said second ink cartridge chambers contain a different number of colors.

57. The ink jet recording apparatus of claim 56, wherein said first ink cartridge includes four chambers that contain cyan, magenta, yellow and black inks, respectively, and said second ink cartridge includes two chambers that contains cyan and magenta inks, respectively.

58. The ink jet recording apparatus of claim 38, wherein said first ink cartridge further comprises a plurality of ink chambers having a first volume for containing high color-density ink and said second ink cartridge further comprises a plurality of ink chambers having a second volume for containing low color-density ink, and said second volume is greater than said first volume.

59. An ink jet recording apparatus for printing onto a recording medium, comprising:

a carriage slidably mounted on said ink jet recording apparatus, said carriage being slidably displaceable in a scanning direction;

a single print head mounted on said carriage;

a first, separable ink cartridge formed with a plurality of chambers respectively containing high color-density inks of a plurality of colors; and a second, separable ink cartridge formed with a plurality of chambers respectively containing low color-density inks, as compared with the inks of said first carriage, of a plurality of colors, wherein said first ink cartridge and said second ink cartridge are mounted on said carriage so as to share said single print head for respectively supplying said high color-density ink and said low color-density ink to said print head.

60. The ink jet recording apparatus of claim 59 further comprising a plurality of ink supply needles mounted on said print head, each of said ink cartridges being formed with an ink supply port coupling an interior of each chamber with an exterior of said ink cartridge for engagement with one of said ink supply needles for the transfer of ink from said chamber to said print head.

* * * * *